United States Patent [19]

Block

[11] Patent Number: 4,881,346

[45] Date of Patent: Nov. 21, 1989

[54] DOOR AND METHOD OF FABRICATING THE SAME

[75] Inventor: Gordon S. Block, Winnebago, Ill.

[73] Assignee: C. Hager & Sons Hinge Manufacturing Company, St. Louis, Mo.

[21] Appl. No.: 209,178

[22] Filed: Jun. 20, 1988

[51] Int. Cl.[4] ..... E06B 3/00; E05D 13/00

[52] U.S. Cl. ..... 49/501; 49/409; 49/411; 49/506; 52/656; 52/822

[58] Field of Search ..... 49/409, 411, 440, 501, 49/506; 52/656, 828, 827, 822, 826

[56] References Cited

U.S. PATENT DOCUMENTS

| | | | |
|---|---|---|---|
| 3,491,501 | 1/1970 | Lundgren | 49/501 X |
| 4,021,988 | 5/1977 | Edeus et al. | 52/656 |
| 4,081,880 | 4/1978 | Edeus | 16/90 |
| 4,193,245 | 3/1980 | Johnson | 52/656 |
| 4,467,562 | 8/1984 | Hemmerling | 49/501 X |
| 4,494,354 | 1/1985 | Johnston | 52/826 X |
| 4,509,291 | 4/1985 | Geisthardt | 49/501 X |
| 4,513,554 | 4/1985 | Johnson et al. | 49/501 X |

*Primary Examiner*—Philip C. Kannan

*Attorney, Agent, or Firm*—Gravely, Lieder & Woodruff

[57] ABSTRACT

A barn door includes vertical members at its ends and lateral members extended between the vertical members which the vertical and lateral members being interlocked where they meet. To this end, the vertical members are channel-shaped, each having a front and a rear wall along with a end wall that connects the front and rear walls, it being formed integral with both. Each vertical member has vertical ribs which project toward each other from its front and rear walls. The lateral members, on the other hand, have vertical slots in their side walls. The ribs of the vertical members snap into the slots of the lateral members and this interlocks the vertical and lateral members. The joints so formed are rendered more secure with screws which pass through the front and end walls of the vertical members and into the side walls of the lateral members. A siding material is attached to the lateral members and at its ends projects under a lip on the front walls of the vertical members. The door so formed is hung from trolleys which roll in a track.

20 Claims, 2 Drawing Sheets

FIG. 1.
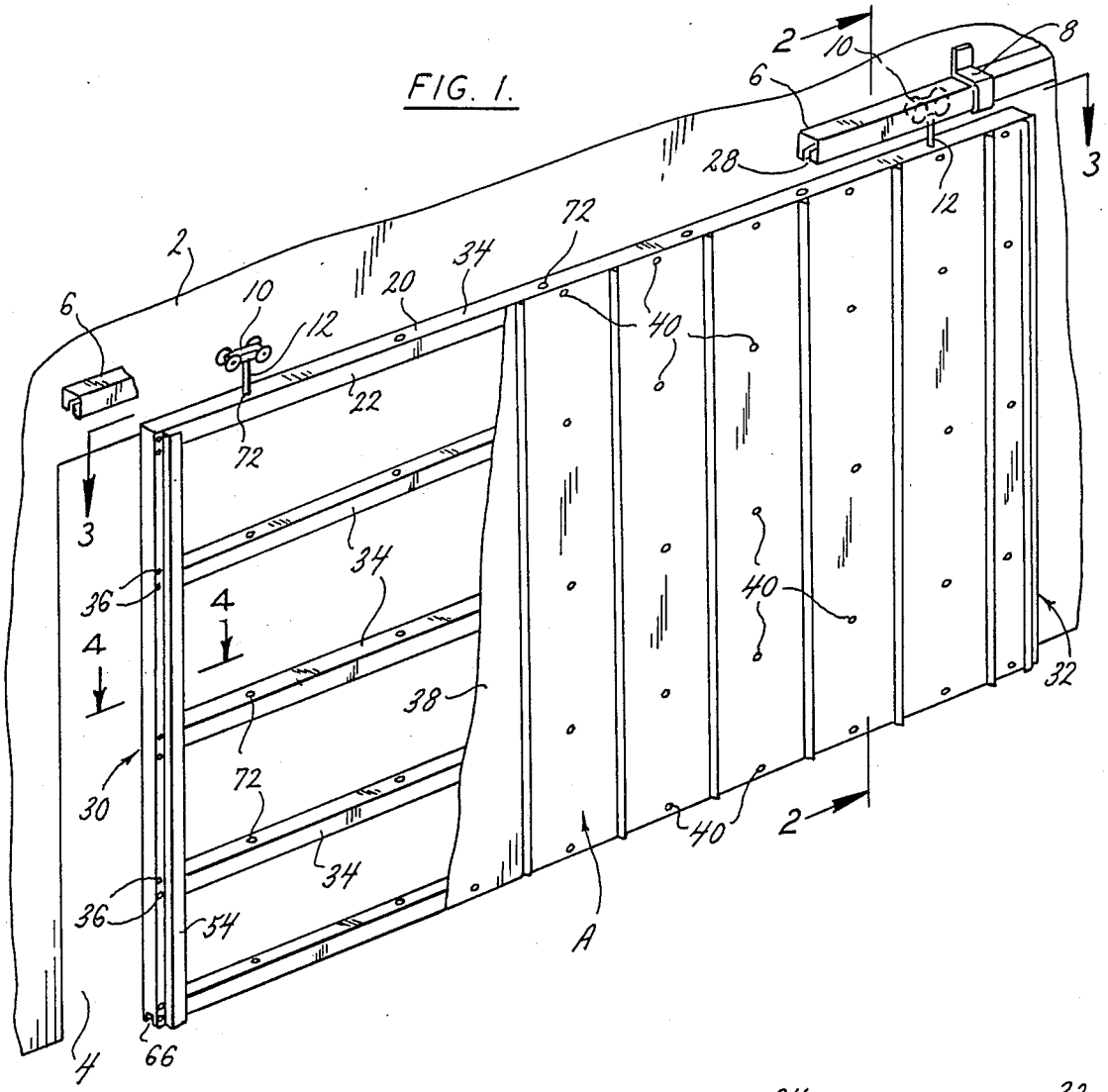
FIG. 3.
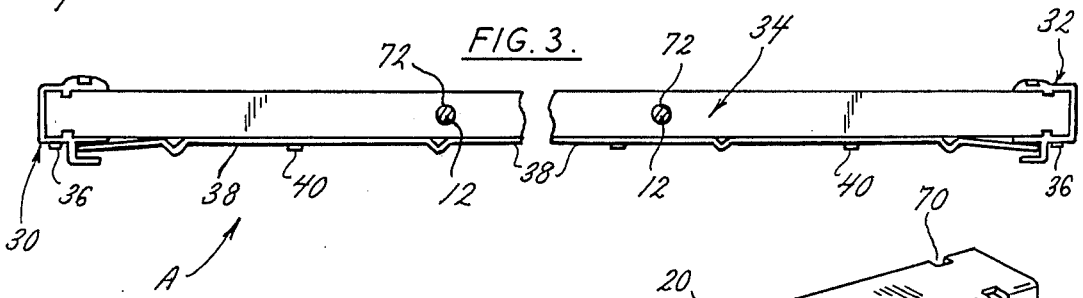
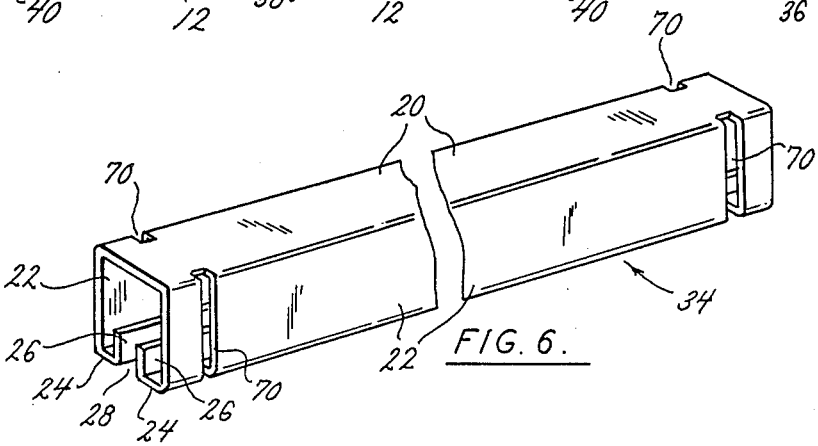
FIG. 6.

DOOR AND METHOD OF FABRICATING THE SAME

BACKGROUND OF THE INVENTION

This invention relates to doors, and more particularly to large doors which may be assembled in the field.

Barns and other buildings in which heavy equipment is stored require large openings to accommodate such equipment, and these openings in turn require doors equally as large to secure the buildings. While various doors exist for closing large openings, perhaps the simplest and most practical is the trolley hung door. For the typical large door opening, this door exists in a single section or panel and is suspended from trolleys which move along a track secured to the building immediately above the door opening and beyond as well. Thus, the door simply slides along that wall of the building in which the opening is located and in so doing moves between its open and closed positions.

It is not uncommon to fabricate trolley hung doors in field, custom fitting them to the openings that they are designed to close. A typical component of such a door could be the track used for the trolleys, for that type of track is a common and inexpensive item of builders' hardware. Another typical component is traditional barn siding. Even so, some specialized components are required.

The present invention concerns a door which may be easily and quickly assembled in the field from inexpensive components. In addition, the components themselves afford a good deal of flexibility in designing the door.

DESCRIPTION OF THE DRAWINGS

In the accompanying drawings which form part of the specification and wherein like numerals and letters refer to like parts wherever they occur FIG. 1 is a perspective view of a large door constructed in accordance with and embodying the present invention, with the door being located along a wall and suspending from a track by means of trolleys;

FIG. 3 is a top view of the door taken along line 3—3 of FIG. 1;

FIG. 6 is a fragmentary view of one of the lateral members in the door; and

DETAILED DESCRIPTION

Figure 2:
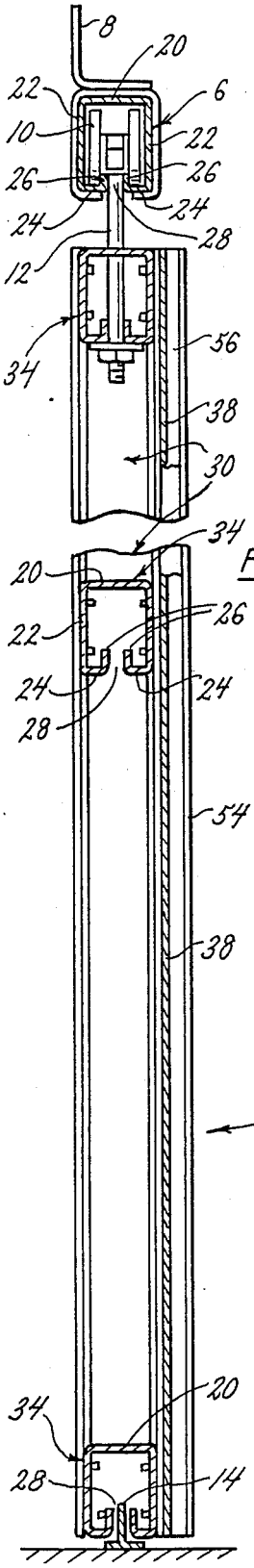
FIG. 2 is a vertical sectional view of the door taken along line 2—2 FIG. 1.

Referring now to the drawings, a building has a door A (FIG. 1) which is supported on a wall 2 and slides relative to that wall to expose or cover a large opening 4, moving between closed and open positions as it does. The building may be and usually is a barn, garage, or some other structure designed to store large equipment, and as a consequence the opening 4 must be large enough to enable the equipment to pass through it. Of course, the door A must be as large as, if not slightly larger than, the opening 4, so as to completely close the opening 4.

As the door A slides between its open and closed positions, and while it is in those positions as well, it is suspended from a track 6 (FIGS. 1 & 2) which is attached to the wall 2 by brackets 8 in a generally horizontal orientation above the upper margin of the opening 4 and laterally beyond one side of the opening 4 as well. The track 6 contains two trolleys 10, and each trolley 10 carries a hanger 12 which depends from it to extend into the door A to which it is attached. Thus, the door A is suspended from the track 6 by means of the two trolleys 10 and their respective hangers 12.

The track 6 is typical of that used to suspend large trolley hung doors, and as such it constitutes (FIG. 2) a roll formed steel member having a top wall 20 and a pair of side walls 22 turned downwardly from the top wall 20 at its sides, with the two side walls 22 being parallel and of equal height. Along the lower margin of each side wall 22 a flange 24 turns inwardly in a horizontal orientation, and each flange along its inner edge has upwardly turned lips 26 which are spaced slightly apart so that a slot 28 exists along the bottom of the track 6. The trolleys 10 are contained wholly within the interior of the track 6, each having wheels which roll along the inwardly turned flanges 24. The hangers 12, which are carried by the trolleys 10, project downwardly through the slot 28, below which they pass into the door A to which they are secured, thus suspending the door A from the trolleys 10 which in turn roll along the track 6.

The door A along its lower edge engages a guide 14 (FIG. 2) which prevents the door A from swinging outwardly away from the wall 2 and opening 4 in it.

Turning now to the door A itself, it includes (FIG. 1) a vertical member 30 at its one end, another vertical member 32 at its opposite end and several lateral members 34 extended between the two vertical members 34. Indeed the vertical members 30 and 32 and lateral members 34 are secured firmly together at the ends of the latter by so-called TEC screws 36, thus providing a rigid framework for the door A. The typical TEC screw is configured as a drill bit at the end of its shank, and immediately beyond the bit the shank has a self-tapping screw thread. In addition, the door A includes a siding material 38 which is attached to the framework formed by the vertical members 30 and 32 and the lateral members 34. The siding material 38 is secured to the lateral members 34 of the framework by more TEC screws 40.

Each vertical member 30 and 32 constitutes an extrusion, preferably of aluminum, that wraps around the ends of the lateral members 34. In particular, each includes (FIGS. 4 and 7) a web or end wall 44 and front and rear walls 46 and 48 which turn laterally in the same direction away from the end wall 46 to produce a channel-shaped configuration having a hollow interior. Being all part of an extrusion, the front and rear walls 46 and 48 and the end wall 44 are formed integral with each other, that is each of the members 30, 32 constitutes a unitary structure. The front and rear walls 46 and 48 lie parallel to each other, their opposed inside faces being spaced apart a distance that is equal to or slightly greater than the width of the lateral members 34. Along their inside faces both the front and back walls 46 and 48 have vertical ribs 50 which project inwardly toward each other, and each rib 50 has a beveled surface 52 that is presented away from the web 44, that is the beveled surfaces 52 are presented toward the open end of the channel-shaped configuration.

Figure 4:
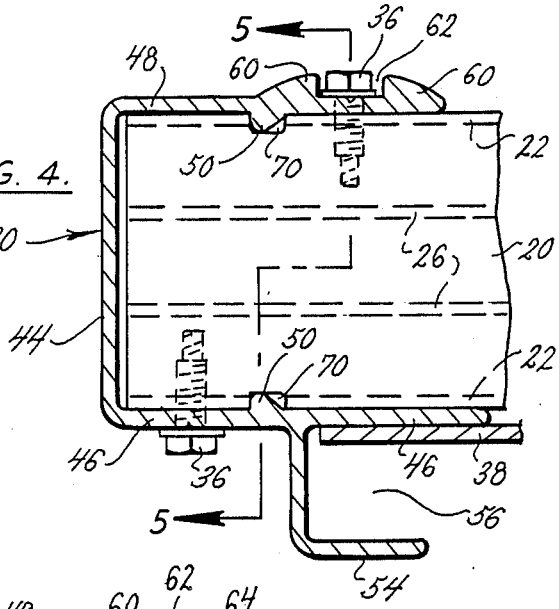
FIG. 4 is a sectional view of one of the vertical members of the taken along line 4—4 of FIG. 1.

Along its outwardly presented surface, the front wall merges into an L-shaped lip 54 which produces a laterally-opening groove 56 along the wall 46 (FIG. 4). The groove 56 is wide enough to accommodate the siding material 38 at the thickest part of the latter. Between the end wall 44 and the lip 54, the front wall 46 is further provided on its outwardly presented face with a shallow groove 58 (FIG. 7) which is used to locate or pilot the TEC screws 36 that pass through the wall 46 into the laterals 34.

Figure 7:
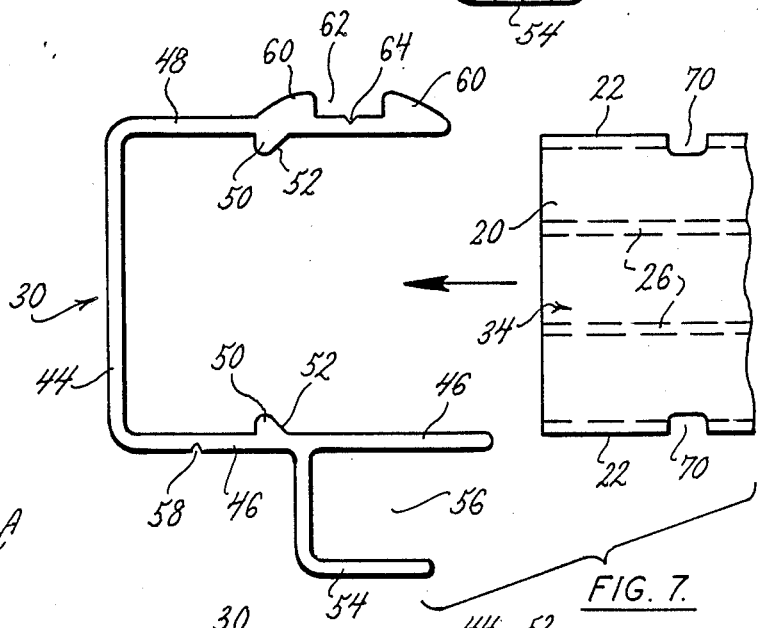
FIG. 7 is a view showing a lateral member being embodied into a vertical member.
Figure 5:
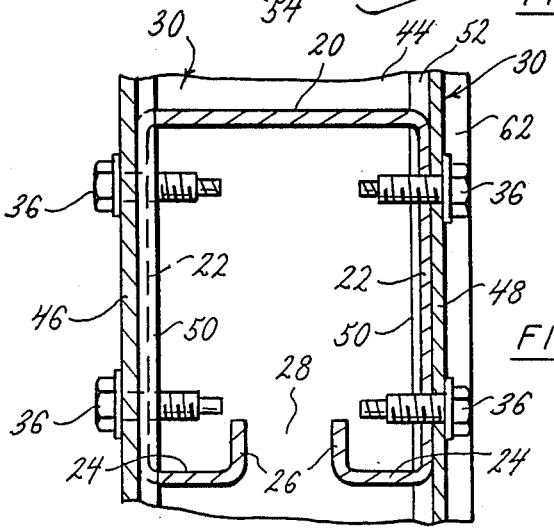
FIG. 5 is a sectional view of the vertical member taken along line 5—5 of FIG. 4.

The rear wall 48 along its outwardly presented surface has an embossment 60 which projects outwardly, presenting arcuate surfaces along the wall 48 that is remote from the end wall 44 (FIG. 7). The embossment 60 contains a groove 62 that is centered within it and is wide enough to accommodate the heads of the TEC screws 36. Extending along the base of the groove 62 is a shallow groove 64, which serves to pilot the TEC screws 36 that pass through the rear wall 48 into the lateral members 34.

The two vertical members 30 and 32 are for the most part identical, although one is reversed in position with respect to the other. Yet they are formed from the same extrusion die. At the lower ends of the two vertical members 30, 32, their end walls 44 are provided with downwardly opening notches 66 (FIG. 1) which receive the door guide 14 at the one side of the door opening 4 wherein the door is moved between its open and closed positions.

The lateral members 34 are preferably of the same cross-sectional configuration and size as the track 6, and thus the track 6 and lateral members may be produced on the same roll-forming equipment (FIGS. 2 & 6). Hence, each lateral member 34 is generally tubular, it having a top wall 20, side walls 22, flanges 24 and lips 26 on the flanges 24, with a slot 28 separating the lips 26. The spacing between the side walls 22 is such that the side walls 22 fit easily between the front and rear walls 46, 48 of the vertical members 30, 32, yet the spacing is greater than the distance between the opposing ribs 50 on the vertical members 30, 32 (FIGS. 4 & 7). The lateral members 34, while having the same cross-sectional configuration as the track 6, differ from the track 6 in that each lateral member 34 at its ends is provided with slots 70 (FIGS. 4, 6 & 7) that are positioned and otherwise configured to receive the ribs 50 on the vertical members 30, 32. In this regard, the ends of the lateral members 34 fit into the spaces between the front and rear walls 46, 48 of the vertical members 30, 32, with the top walls 20 of the lateral members 34 being presented upwardly. Moreover, the end edges of the lateral members 34 extend essentially all the way to the end walls of the two vertical members 30, 32, or in other words, the lateral members 34 are projected to the fullest extent into hollow interiors of the vertical members 30, 32. The slots 70 in the ends of each lateral member 34 extend vertically through the side walls 22 for the full height thereof and partially into the top wall 20 and flanges 24, and moreover each slot 70 is set back from the nearby end edge a distance equal to the set back of the ribs 50 from the end walls 44 of the vertical members 30, 32. The arrangement enables the ribs 50 to project into the slots 70 and thus interlock the lateral members 34 and vertical members 30, 32 (FIG. 4).

To effect this interlocking, the end of a lateral member 34 is inserted into the hollow interior of a vertical member 30 or 32 with the lateral member 34 being oriented perpendicular to the vertical members 30, 32 (FIG. 7). The front and rear walls 46, 48 of the vertical member 30 or 32 are spaced far enough apart to easily accommodate the end of the lateral member 34, but after a short advance, the end edges on the side walls 22 of the lateral member 34 encounter the ribs 50 on the front and rear walls 46, 48 of the vertical member 30 or 32. At this time a force of sufficient magnitude is applied to the lateral member 34 to spread the ribs 50 apart against the bias exerted by the natural resiliency of the metal in the vertical member 30 or 32. Indeed, the end edges on the side walls 22 of the lateral member 34 bear against the beveled surface 52 of the ribs 50 and cam the ribs 50 and walls 46, 48 of the vertical member 30 or 32 apart. The ribs 50 ride upon the outwardly presented surfaces of the side walls 22 for the lateral member 34 as the lateral member 34 continues to advance, yet the vertical member 30 or 32 undergoes no permanent yield, that is it experiences no plastic deformation, and after a short distance the slots 70 in the lateral member 34 align with the ribs 50, whereupon the ribs 50 snap into those slots 70 under the natural resilience of the metal in the vertical member 30 or 32. At this time the TEC screws 36 are driven through the front and rear walls 46, 48 of the vertical member 30 or 32 at the shallow pilot grooves 58 and 64 in those walls.

The lateral members 34 further differ from the track 6 in that the top wall of each lateral member 34 has holes 72 arranged at equally spaced intervals of perhaps 24" to 30" inches in its top wall 20 (FIG. 1). Each hole 72 is large enough to accommodate the end of the hanger 12 for one of the trolleys 10.

The lateral members 34 are arranged in the door A with their top walls 20 presented upwardly. One lateral member 34 extends along the top of the door A, and the hangers 12 from the trolleys 10 project downwardly through two holes 72 in this lateral member 34 (FIGS. 1 & 2). Indeed, the hangers 34 also pass through the slot 28 in that member 34, below which they are provided with nuts or other fasteners to suspend the entire door A from the hangers 12. Another lateral member 34 extends along the very bottom of the door A, and the slot 28 and hollow interior of this member align with the notches 66 at the bottom of the two vertical members. The door guide 14 projects into the slot 28 of the lowermost lateral member 34 and prevents the bottom of the door A from swinging outwardly away from the opening 4 (FIG. 2).

If desired, conventional square tubing may be used for all of the lateral members 34, except perhaps the bottom lateral member 34.

The siding materal 38 extends over the forwardly presented side walls 22 of the lateral members 34, to which it is secured with the TEC screws 40 (FIG. 1), and at its ends, fits into the grooves 56 formed by the L-shaped lips 54 on the vertical members 30, 32. It may be the ribbed metal siding used quite commonly on barns and commercial buildings or it could be simply sheets of plywood or for that matter any other strong sheet material.

The door A is easily assembled, and indeed may be assembled in the field with little effort. To do so, one obtains enough lateral members 34 to provide a solid backing for the siding material 38 when spread over the height of the opening 4, and these lateral members 34 must of course be at least as long as the opening 4 is wide. One also obtains two vertical members 30, 32 that are about as high as the opening 4. The ends of the lateral members 34 are then fitted into the hollow interiors of the vertical member 30 at desired intervals — indeed with enough force to advance the end edges of those lateral members 34 all the way to end wall 44 of the vertical members 30 (FIGS. 4 & 7). In so doing, the end edges of the lateral members 34 come against the beveled surfaces 52 on the ribs 50 of the vertical members 30 and spread those ribs 50 and the walls 46 and 48, of which they form a part, at least until the slots 70 in the members 34 align with ribs 50. At that time the ribs 50 snap into the slots 70 and interlock the lateral members 34 and vertical members 30. This interlock holds the vertical members 30 and lateral members 34 together while the other vertical member 32 is fitted to the opposite ends of the lateral members 34. Again enough force is exerted to spread the ribs 50 and walls 46, 48 of the vertical member 32, and indeed the ribs 50 of that member 32 are brought into alignment with the slots 70 in the opposite ends of the lateral members 34. When this occurs the vertical member 32 also interlocks with the lateral members 34.

With the two vertical members 30, 32 and the several lateral members 34 so interlocked, the lateral members 34 are adjusted simply by sliding them along the vertical members 30, 32 until they assume the desired positions. Once the frame formed by the members 30, 32 and 34 is square, two TEC screws 36 are driven through each wall 46, 48 of the vertical members 30, 32 at the end of every lateral member 34, so that at each end of every lateral member 34 four screws 36 penetrate the lateral members 34. The screws 36 along the front wall 46 of each vertical member are driven at the shallow pilot groove 58 in that wall simply by inserting the drill bit point of the screw into the groove 58 and forcing the screw 36 against the wall 46 while at the same time rotating it. The point bores through the front wall 46 and the underlying side wall 22 of the lateral member 34, creating two aligned holes into which the threaded portion of the screw 36 advances, cutting a thread as it does. The screw 36 is turned down until its head bears snugly against the face of the front wall 46. More screws 36 are inserted into the rear wall 48 of each vertical member 30, 32 with these screws being located along the shallow groove 64 in the larger groove 62 of the embossment 60 on the rear wall 48. When these screws 36 are turned down to their fullest extent, their heads lie within the larger groove 62, such that the arcuate surfaces of the embossment 60 lead up to the end surfaces of the heads. This prevents the heads of the screws 36 that are along the rear walls 48 from snagging on the jambs of the door opening 4 as their respective vertical members 30, 32 move along these jambs.

Finally, the siding material 38 is laid over the lateral members 34 and its ends are inserted into the grooves 56 formed by the lips 54 along the front walls 46 of the two vertical members 30, 32. It is secured to the lateral members 34 with the TEC screws 40 which are driven through it and into the forwardly presented side walls 22 of the lateral members 34.

Finally, the notches 66 are cut into the end wall 44 of the two vertical members 30, 32 so as to effect a continuation of the slot 28 in the lowermost lateral member 34.

Thus, the door A is fabricated in the field with considerable ease.

The door A which is so fabricated is then hung from the trolleys 10 that are in the track 6 simply by raising the door A to an elevated position at the opening 4 and maneuvering the hangers 12 on the trolley 10 into two selected holes 72 in the top wall 20 of the uppermost lateral member 34. Nuts are threaded over the hangers 12 and adjusted until the door A acquires the proper elevation.

This invention is intended to cover all changes and modifications of the example of the invention herein chosen for purposes of the disclosure which do not constitute departures from the spirit and scope of the invention.

What is claimed is:

1. A door comprising: first and second vertical members located at the ends of the door, each vertical member having spaced apart front and rear walls and an end wall connecting the front and rear walls so that the vertical members in cross-section are generally channel-shaped, the vertical members being oriented with their end walls presented away from each other so that their hollow interiors open toward each other, each vertical member having a rib on at least its front or rear wall, each rib extending substantially the entire height of the vertical member on which it is located and projecting into the hollow interior of that member, each rib further being substantially continuous along the wall of the member on which it is located; a plurality of lateral members extended between the vertical members and at their ends being fitted into the hollow interiors of the vertical members, the lateral members at their ends having vertical slots which align with and receive the ribs on the vertical members, so as to interlock the vertical and lateral members; connecting means for securing the vertical members to the lateral members; and a siding material extended over and attached to the lateral members.

2. A door according to claim 1 herein the front and rear walls of each vertical member have free edges which are presented away from the end wall of that member, and the rib for that member is offset from the free edge of the wall along which it is located.

3. A door according to claim 1 wherein the front and rear walls of each vertical member have free edges which are presented away from the end wall of that member, and the rib for the member is located intermediate the free edge of the wall along which it extends and the end wall.

4. A door according to claim 1 wherein both the front and rear walls of the vertical members have ribs which project into the interiors of those members to interlock the vertical and lateral members.

5. A door according to claim 4 wherein each vertical member is of unitary construction with its front and rear walls being generally parallel and maintained in a fixed and determined position by the end wall.

6. A door according to claim 5 wherein the spacing between the front and rear walls of each vertical member is for the most part about the same as the width of the lateral members at their ends, but between the ribs the spacing is less than the space between the lateral members at the ends of those members.

7. A door according to claim 6 where the ribs of each vertical member have beveled surfaces which are presented away from the end wall of that vertical member, so that a lateral member upon being forced into the hollow interior of the vertical member will cam the ribs, and the front and rear walls on which they are located, apart.

8. A door according to claim 7 wherein the connecting means have heads and the rear wall of each vertical member has an embossment provided with a groove in which the heads of the connecting means along that wall lie.

9. A door according to claim 7 wherein the front wall of each vertical member has a lip thereon which forms a groove in which the end of the sheeting is received.

10. A door according to claim 7 wherein at least the lowermost lateral member has a longitudinally directed slot which opens out of the bottom of the door.

11. A door according to claim 7 wherein each lateral member has a connecting wall and spaced apart side walls, and the slots are in the side walls.

12. A door according to claim 11 wherein the slots extend the full height of the side walls for the lateral members.

13. A door comprising: first and second vertical members of unitary construction located at the ends of the door, each vertical member having spaced apart and generally parallel front and rear walls and an end wall connecting the front and rear walls and maintaining the front and rear walls in a fixed and determined position with respect to each other, all such that the vertical members in cross-section are generally channel-shaped, the vertical members being oriented with their end walls presented away from each other so that their hollow interiors open toward each other, the front and rear walls of each vertical member each having a rib which projects into the interior of that vertical member; a plurality of lateral members extended between the vertical members and at their ends being fitted into the hollow interiors of the vertical members, the spacing between the front and rear walls of each vertical member being for the most part about the same as the width of the lateral members at their ends, except for between the ribs where the spacing is less than the space between the lateral members at the ends of those members, the lateral members at their ends having slots which align with and receive the ribs on the vertical members, so as to interlock the vertical and lateral members, the ribs of each vertical member having beveled surfaces which are presented away from the end wall of that vertical member, so that a lateral member upon being forced into the hollow interior of the vertical member will cam the ribs and the front and rear walls on which they are located apart; connecting means for securing the vertical members to the lateral members, the connecting means having heads and the rear wall of each vertical member having an embossment provided with a groove in which the heads of the connecting means along that wall lie; and a siding material extended over and attached to the lateral members.

14. In combination with a wall having an opening therein, a track attached to the wall above the opening and laterally beyond the opening, trolleys on the track, and hangers extending downwardly from the trolleys to below the track, an impoved door for closing the opening, said door comprising: vertical members located at the ends of the door, each vertical member having spaced apart front and rear walls which are generally parallel and an end wall connecting the front and rear walls, the walls being joined together as an integral channel-shaped unit, the vertical members being oriented with their end walls being presented away from each other so that their hollow interiors open toward each other, each of the front and rear walls having a vertically directed rib which projects into the hollow interior of the member; generally tubular lateral members extended between the vertical members and having their ends fitted into the hollow interiors of the vertical members, each lateral member having side walls which are spaced apart a distance about equal to the spacing between the front and rear walls of the vertical members so that the vertical members within their hollow interiors receive the ends of the lateral members, the spacing between the side walls of the lateral members being greater than the spacing between the ribs on the front and rear walls of the vertical members, the side walls of the lateral members having at their ends vertically directed slots into which the ribs on the front and rear walls of the vertical members project to interlock the vertical and lateral members, the uppermost lateral member being attached to the hangers on the trolleys to suspend the door from the track; and a siding material extended over and being attached to the lateral members.

15. The combination according to claim 14 and further comprising fasteners extended through the front and rear walls of the vertical members and into the side walls of the lateral members to secure the vertical and lateral members firmly together.

16. The combination according to claim 14 wherein the unitary vertical members are resilient enough to be spread apart a distance sufficient to enable the side walls of the lateral members to pass between the ribs of the vertical members without the vertical members undergoing a permanent deformation.

17. The combination according to claim 14 wherein each of the vertical members on its front wall has a lip which forms a laterally opening groove with the front wall, and the siding material projects into the groove formed by the lip.

18. The combination according to claim 14 wherein the rear wall of each vertical member has an embossment thereon, with the embossment extending vertically and having a vertically directed groove which opens rearwardly out of it, and further comprising headed screws extended through the front and rear walls of the vertical members and into the side walls of the horizontal members, the heads of the screws that pass through the rear walls of the vertical members being within the groove of the embossments that are along those rear walls.

19. A process for assembling and hanging a door from trolleys that are in a track on a building wall to close an opening in the wall, said process comprising: fitting generally tubular lateral members into channel-shaped vertical members, the lateral members having spaced apart side walls with vertically directed slots in those side walls at the ends of the members, the vertical members having front and rear walls and an end wall connecting the front and rear walls such that the front, rear and end walls of each vertical member constitute a unitary structure, the front and rear walls of each vertical member having ribs which project toward each other, the lateral members being inserted into the vertical members such that the side walls of the lateral members are along the front and rear walls of the vertical members with the ribs of the vertical members being projected into the slots at the ends of the lateral members to interlock the vertical and lateral members; inserting fasteners through the front and rear walls of the vertical members and into side walls of the lateral members; attaching a siding material to the lateral members to complete the door; and connecting the trolleys to the uppermost lateral member of the door so that the door is suspended from the trolleys.

20. The process according to claim 19 wherein the ribs of the vertical members are normally closer together than the side walls of the lateral members; and the step of inserting the lateral members into the vertical members includes spreading the front and rear walls of the vertical members apart against the natural bias of the material from which the vertical members are made to enable the side walls of the lateral members to pass between the ribs, and bringing the slots in the side walls of the lateral members into alignment with the ribs of the vertical members so that the ribs snap into the slots.

* * * * *